United States Patent [19]

Harvey

[11] 4,023,842

[45] May 17, 1977

[54] PORTABLE BAG SPREADER

[76] Inventor: Edwin B. Harvey, 1106 Timbergrove, Houston, Tex. 77008

[22] Filed: July 28, 1975

[21] Appl. No.: 599,418

[52] U.S. Cl. ..... 294/1 R; 248/99; 294/55

[51] Int. Cl.[2] ..... A47F 13/08; B65F 1/06

[58] Field of Search ..... 294/1 R, 19 R, 55, 93, 294/97, 99 R; 15/104.8, 257.1, 257.4, 257.7, 257.8; 56/400.11, 400.13; 150/49; 248/95, 97, 99, 100, 101

[56] References Cited

UNITED STATES PATENTS

| | | | |
|---|---|---|---|
| 481,957 | 9/1892 | Klank | 248/99 |
| 690,412 | 1/1902 | Erickson | 248/99 |
| 1,157,138 | 10/1915 | Wunder | 248/99 |
| 2,505,289 | 4/1950 | Haslett | 294/93 |
| 3,240,457 | 3/1966 | Backlund et al. | 248/99 |
| 3,711,141 | 1/1973 | Soergel | 294/55 |
| 3,747,653 | 7/1973 | Ringer | 15/257.1 X |
| 3,754,785 | 8/1973 | Anderson | 294/19 R |

*Primary Examiner*—Johnny D. Cherry

[57] ABSTRACT

A portable bag spreader is disclosed for use with flexible garbage or trash bags which includes a resilient frame with divergent legs which must be compressed toward each other in order to mount a bag upon the spreader, the resulting tension between the frame and the mouth of the bag serving to maintain the bag in place. This abstract is not to be construed in any way to define or limit the invention set forth below.

1 Claim, 5 Drawing Figures

PORTABLE BAG SPREADER

This invention relates to a portable spreader for use with flexible bags for holding open the mouths of such bags to receive refuse such as leaves or glass clippings.

Refuse bags made from stretchable plastic materials, such as polyethylene, have become a common article of commerce. Various devices for spreading the openings of such bags are known in the prior art, but many of these devices have been specifically designed to fulfill a required function in a fixed orientation as, for example, the holder shown in U.S. Pat. No. 3,684,225 which is designed to be mounted on the inside of a cupboard door for retaining a plastic garbage bag in an upright position. Other devices, such as those shown in U.S. Pat. No. 3,754,785 are portable so that the bag opening may be oriented in any desired position, but are of rather complex construction with numerous parts requiring careful assembly.

It is a principal object of the present invention to provide a light, inexpensive portable bag spreader capable of holding a bag thereon with its mouth spread open for convenient receipt of leaves, clippings or other refuse which may be swept or raked there into.

Another object is to provide such a spreader which is resilient so that the tension between the spreader frame and a bag mounted on the frame is sufficient to retain the bag in position without other attachment to the spreader.

A further object is to provide such a spreader which is cheap and easy to manufacture and which is readily assemblable and disassemblable without the use of tools.

A still further object is to provide such a spreader which includes a handle portion adapted to extend from the mouth of a bag mounted on the spreader so as to be readily accessible, and including feet for retaining the spreader and bag opening in a normally upright position.

These and other objects and advantages of the invention will become apparent from the following specification, drawings and claims. In the accompanying drawing, wherein like reference numerals indicate like parts:

Figure 1:
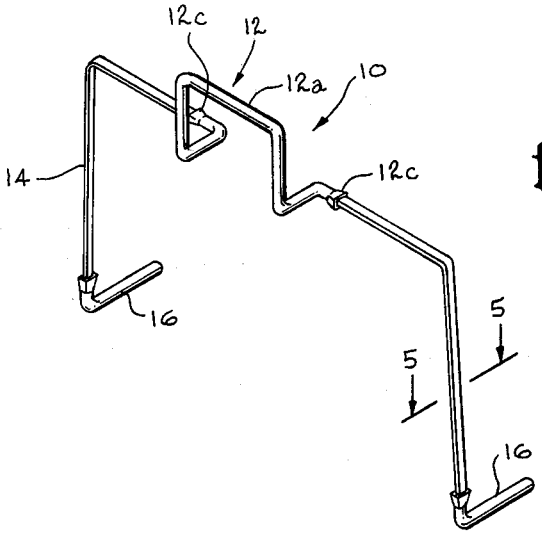
FIG. 1 is a front and top perspective view of a bag spreader in accordance with the present invention in assembled position.
Figure 2:
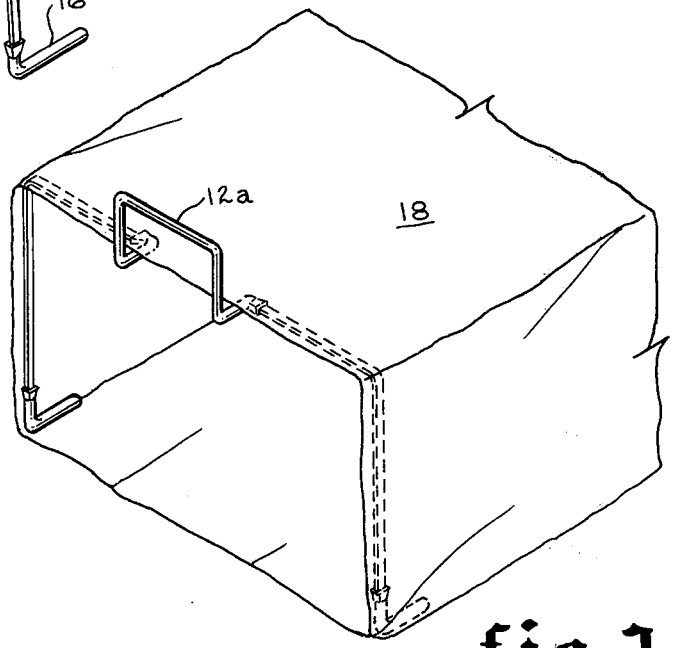
FIG. 2 is a view similar to FIG. 1 with a trash bag mounted on the spreader.
Figure 3:
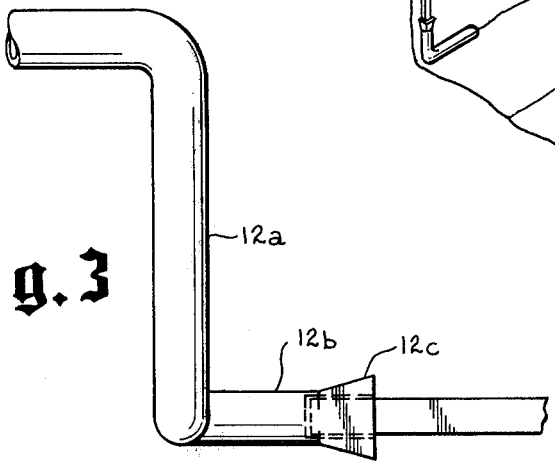
FIG. 3 is an enlarged detail of a portion of the handle of the spreader of FIG. 1, showing the means for attaching the legs thereto.
Figure 4:
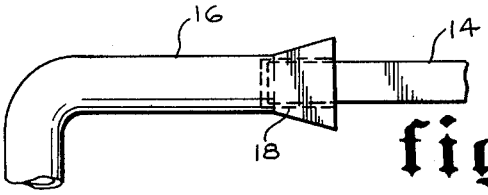
FIG. 4 is an enlarged detail of a portion of one of the feet showing the means for attaching the legs thereto.
Figure 5:
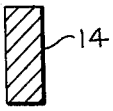
FIG. 5 is an end view of one of the legs showing its cross-sectional configuration.

Referring now to FIG. 1, there shown the preferred embodiment of the bag spreader according to the present invention comprising a resilient frame 10 having a central upper portion with a divergent downwardly extending leg at each end thereof. The central portion preferably includes a handle 12 having a first forwardly and upwardly extending portion 12*a* formed in the general shape of an inverted "U", which first portion, as shown in FIG. 2, is adapted to extend outwardly and upwardly from the mouth of a bag mounted upon the frame 10. The handle 12 also includes a second portion 12*b* which extends rearwardly from the first portion 12*a* and is adapted to be received within the mouth of the bag mounted upon the spreader frame. As shown, the second portion comprises a continuation of the two legs of the first portion which are turned rearwardly at right angles to the first portion and extend rearwardly in parallel relationship for a short distance to a second right angle bend from which the two ends diverge at approximately 180° in a common plane.

The handle 12 is preferably round and may be formed from a single piece of stock, such as metal tubing, bent into the proper configuration. The opposed ends of the handle are deformed into generally rectangular openings as indicated at 12*c* to provide means for receiving the upper ends of the two divergent and downwardly extending legs 14. The legs 14 are preferably of rectangular cross-sectional configuration and formed of any suitable resilient material such as metal or plastic. While the legs 14 are shown as being of generally "L" shaped configuration, they may, of course, be made in other configurations as desired.

At the lower end of each leg 14 is provided a detachable foot 16 adapted to extend generally rearwardly from the legs 14 to retain the bag spreader in a self-supporting upright position. The feet 16 include means for releasable attachment to the legs 14 comprising recesses 18 of generally rectangular cross-sectional configuration similar to those in the handle 12, and of approximately the same size as the legs 14 within which the legs 14 may be received. The feet 16 may be formed of any suitable material.

The non-circular cross-sectional configuration of the legs 14 and the recesses in the handle 12 and feet 16 assures that the assembled frame will remain rigid and that the handle and feet will not swivel or rotate with respect to the legs 14.

It will be appreciated that the bag spreader thus provided may be easily manufactured and shipped in disassembled form in five separate pieces and may be assembled by the user thereof without the use of tools by inserting the legs 14 into the opening 12*c* of the handle 12 and by placing the feet 16 on the lower end of the leg 14. In like manner the spreader may be disassembled for storage after use and reassembled as needed.

The parts of the spreader are so sized and configured that when the spreader is assembled as shown in FIG. 1, the lower ends of legs 14 and the feet 16 diverge from each other sufficiently that the spreader frame 10 may not be received within the mouth of a bag 18, such as a common polyurethane trash bag, with which the spreader is to be used unless the legs 14 are compressed toward each other to reduce the distance between the lower ends of the legs. When the frame is so compressed it may be inserted within the mouth of the bag 18 and the resilience of the frame will urge the legs toward their normally divergent position. The resulting tension between the inner circumference of the bag 18 and the legs 14 and feet 16 provides sufficient tension to retain the bag on the frame during use. While the frame resilience is preferably provided by the legs 14 it will be apparent that it could as easily be provided by a deformable handle 12.

As shown in FIG. 2, with a bag 18 mounted on the frame, all parts of the frame are received within the opening of the bag 18, except the first portion 12*a* of the handle 12 which extends forwardly and upwardly of the bag opening to provide a convenient means for orienting and holding the bag and frame while leaves, grass clippings, etc. are swept or raked into the bag.

When the bag has been filled, the frame may be removed therefrom by again compressing the lower ends of the legs 14 toward each other to relieve the tension between the bag and the frame while the bag is removed from the frame.

The foregoing disclosure and description of the invention is illustrative and explanatory thereof, and various changes in the size, shape and materials, as well as in the details of the illustrated construction may be made within the scope of the appended claims without departing from the spirit of the invention.

What is claimed is:

1. A spreader for holding open the mouth of a flexible bag, said spreader comprising:

a resilient frame having a central upper portion with a divergent downwardly extending leg at each and end thereof, said frame in its relaxed condition being too large to fit within the mouth of a bag, with which it is to be used, whereby, the divergent ends of the legs must be compressed toward each other to mount the bag upon the frame, the resulting tension between the bag and the frame serving to retain the bag upon the frame, a handle in said central portion, adapted to extend outwardly from the mouth of a bag mounted upon said frame, and a foot portion on the lower end of each of said legs for maintaining the spreader in an upright position, said legs being formed of non-circular cross-sectional configuration, and said handle and feet being provided with leg receiving recesses of the same cross-sectional configuration as said legs, and appropriately sized to receive the ends of said legs therein, whereby said frame may be assembled by inserting said ends of said legs into said leg receiving recesses in said handle and feet.

* * * * *